US006441799B2

(12) United States Patent
Spaulding

(10) Patent No.: US 6,441,799 B2
(45) Date of Patent: Aug. 27, 2002

(54) POLYURETHANE FOAM CONCEALMENT PANEL

(75) Inventor: Herman Spaulding, Columbus, OH (US)

(73) Assignee: Tiger Concealment, Inc., Columbus, OH (US)

( * ) Notice: Subject to any disclaimer, the term of this patent is extended or adjusted under 35 U.S.C. 154(b) by 0 days.

(21) Appl. No.: 09/833,223

(22) Filed: Apr. 13, 2001

Related U.S. Application Data

(63) Continuation-in-part of application No. 09/312,350, filed on May 14, 1999, now abandoned.

(51) Int. Cl.[7] ..... H01Q 1/42
(52) U.S. Cl. ..... 343/872; 343/873
(58) Field of Search ..... 343/872, 873, 343/770, 771, 713; H01Q 1/42

(56) References Cited

U.S. PATENT DOCUMENTS 5,283,592 A * 2/1994 Bogoral et al. ..... 343/782
5,373,305 A * 12/1994 Lepore, Jr. et al. ..... 343/782
5,373,306 A * 12/1994 Amore et al. ..... 343/872
5,499,219 A * 3/1996 Brenner et al. ..... 367/151
5,625,369 A * 4/1997 Newman ..... 343/770
5,852,424 A * 12/1998 Reineck et al. ..... 343/872

* cited by examiner

*Primary Examiner*—Don Wong
*Assistant Examiner*—Trinh Vo Dinh
(74) *Attorney, Agent, or Firm*—Jeffrey Furr

(57) ABSTRACT

The invention related to a polyurethane foam panel which is substantially RF-transparent from 0 MHz to 100,000 MHz, & OMNI antennas and which can be camouflaged by application of paint and other coatings to match the exterior surfaces of buildings, rooftops, exterior walks, silos, flagpoles, steeples, and other structures on which such antennas may be installed. These foam panels are used to form an inexpensive, safe, efficient, structurally sound method to camouflage cellular, PCS, RADOM & OMNI, and other antennas.

16 Claims, 7 Drawing Sheets

POLYURETHANE FOAM CONCEALMENT PANEL

CROSS-REFERENCES TO RELATED APPLICATIONS

This application is a continuation-in-part of application Ser. No. 09/312,350, filed May 14, 1999, now abandoned.

STATEMENT TO INVENTIONS MADE UNDER FEDERALLY-SPONSORED RESEARCH AND DEVELOPMENT

None

BACKGROUND OF THE INVENTION

1. Field of the Invention

This invention relates to the art of camouflaging antennas through the use of polyurethane foam panels that either cover the antenna or are used to form antenna enclosures that blend into the architecture, shape and feel of the building or location that they are situated at.

2. Description of Prior Art

With the extensive requirement and use of antennas for radio, cellular, PCS and RADOM, OMNI and other wireless communications as well as other uses and the requirements or desires of governments, communities, builders, and property owners to have architectural structures that are artistically pleasing, there exists a significant and growing demand for the concealment and camouflage of antennas so that they match the architectural design of the buildings and the other structures on which they are situated.

Numerous methods of antenna camouflage have been attempted. These prior methods have been found to be lacking in RF-transparency and in structural integrity, expensive, subject to UV and environmental degradation, and difficult to match to the colors and textures of the surrounding architecture. Some of the current methods employ multiple layers of materials such as fiberglass, conventional ABS (acrylonitrile butadiene styrene), vinyl laminated polyester, or plastic.

For example, U.S. Pat. No. 4,710,778 to Radov illustrates concealing a small satellite dish in a hole in the roof of a home. A bulging dome-like canopy is used to protect the dish while allowing the dish to have some degree of movement.

U.S. Pat. No. 5,349,362 to Forbes et al. illustrates concealing an antenna in a vent pipe of a building.

U.S. Pat. No. 5,375,353 to Hulse illustrates the use of a weather resistant fabric, such as vinyl covered polyester cloth with an outer coating of polyvinyl chloride (PVC), to cover the steel girders of various portions of an antenna tower.

U.S. Pat. No. 5,852,424 to Reineck et al. illustrates an antenna enclosure designed to allow full reception and transmission of electromagnetic waves while being made of building elements designed to be substantially self supporting. The building elements have inner cores with an outer skin layer.

While each of these approaches may be suitable for their intended uses yet there is still significant room for improvement within the art.

Historically, cellular plastic polyurethane foams are conventionally made by mixing ingredients and curing the polymerizing mass in a mold. Thus, U.S. Pat. No. 2,814,600 describes mixing polyurethane with water and a tertiary amine catalyst. The reaction of the polymer with water releases carbon dioxide, with the result that the mass foams into a cellular material.

As disclosed in U.S. Pat. No. 5,185,383 , Polyurethane foams have been used in roofing, insulation of tanks, piping, and refrigerated equipment as well as many other housings requiring insulation with good dimensional stability.

U.S. Pat. No. 5,625,369 by Newman discloses a concealment panel which has a polyurethane foam panel component, but the Newman invention is a sandwich concealment panel. It has multiple layers of materials, not all of which are made of polyurethane foam. The polyurethane foam component of the Newman sandwiched panels is not structurally sound enough to consist solely of polyurethane foam. The Newman invention has a u-shape bracket member that surrounds the sandwiched panels. This presents problems as sandwiched panels do not weather well and the layers come apart, requiring constant replacement and repair. The Newman invention also discloses a panel which has a pattern of stucco, brick, stone, plastic, or wood grain, but the patterns are not directly molded into the panel and the panels are not solely made of polyurethane foam. This requires extra steps and expense in the manufacturing process.

U.S. Pat. No. 5,283,592, by Bogorad et al., U.S. Pat. No. 5,373,305 by Lepore, Jr. Et .al and U.S. Pat. No. 5,373,306 by Amore et .al discloses the use of polyurethane foam with RF transmission but not used for the concealment of the RF transmitting and receiving devices. The polyurethane foam disclosed is also not structurally sound.

The use of a polyurethane foam which is substantially RF-transparent from 0 MHz to 100,000 MHz provides an inexpensive, safe, durable, structurally sound and efficient means to conceal and camouflage cellular, PCS, RADOM & OMNI and other wireless antennas.

There is still room for improvement in the art.

1. Field of the Invention

U.S. Class 343–872: 52/281

2. Description of related art including information disclosed under 37 CFR § 1.97**>and 1.98<.

SUMMARY OF THE INVENTION

It is the object of this invention to provide an inexpensive, safe, structurally sound, durable efficient means to camouflage antennas either directly or through the use of an antenna enclosure.

This objective can be reached through the use a polyurethane foam panel which is substantially RF-transparent from 0 MHz to 100,000 MHz, which possesses structural capability of cellular, PCS, and RADOM & OMNI antennas, and which can be camouflaged by application of paint and other coatings to match the exterior surfaces of buildings, rooftops, exterior walks, silos, flagpoles, steeples and other structures on which such antennas may be installed.

The polyurethane foam panel can be use singularly or used to form an antenna enclosure. It has been found that polyurethane foam panels are substantially RF-transparent while being an extremely structurally sound material. It also has the advantage that a required thickness or hardness can be created by changing the mixture of the components used to make the polyurethane foam panels. Polyurethane Foam Panels are cost-effective and safe to be handled.

BRIEF DESCRIPTION OF THE DRAWING

Without restricting the full scope of this invention, the preferred forms of this invention are illustrated in the following drawings.

DESCRIPTION OF THE PREFERRED EMBODIMENT(S)

Figure 1:
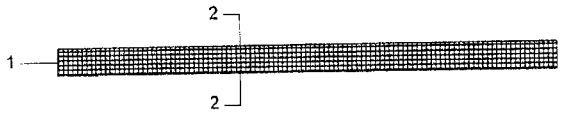
FIG. 1 is a cross-section view of the concealment panel. It is made of a single layer of polyurethane foam.
Figure 2:
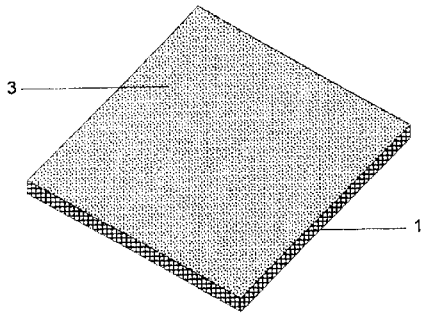
FIG. 2 shows the concealment panel with a stucco pattern.
Figure 5:
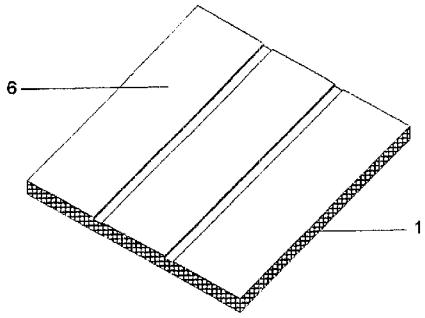
FIG. 5 shows the concealment panel with a plastic pattern.
Figure 3:
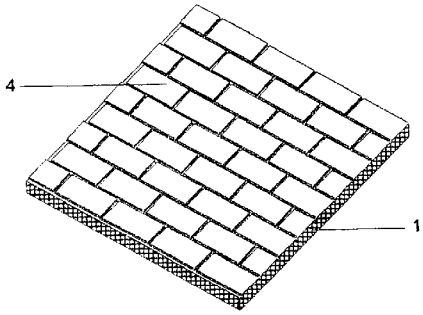
FIG. 3 shows the concealment panel with a brick/tile pattern.
Figure 6:
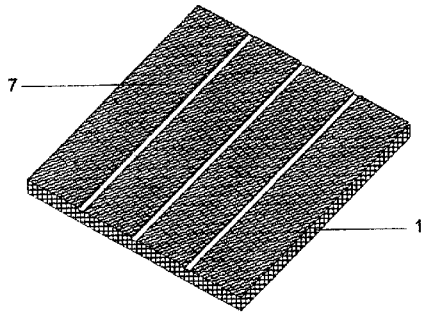
FIG. 6 shows the concealment panel with a wood grain pattern.
Figure 4:
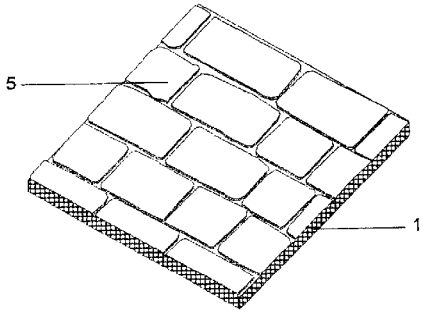
FIG. 4 shows the concealment panel with a stone pattern.

The preferred embodiment of the invention is a polyurethane foam panel 1 as shown in FIG. 1 with two outer sides 2 which can have a distinct pattern or texture. The patterns can be any desired or required patterns. The pattern can be a stucco pattern 3 as shown in FIG. 2. It can be a brick pattern 4 as shown in FIG. 3. As in FIG. 4 it can be a stone pattern 5. FIG. 5 shows the concealment panel with a plastic pattern 6. FIG. 6 shows a wood grain pattern 7.

The preferred embodiment of the polyurethane foam panel 1 is formed from the mixture of a one to one ratio mixture by weight of UTC (Urentane Technology Company, Inc.) A Component (Polymeric MDI) and UTC B Water Blown B components at a temperature of 70° Fahrenheit. The A component is composed of Polymethylene polyphenylene ester. The B component is a Polyether polyol blend.

The preferred embodiment of the polyurethane foam device for the concealment panel 1 is formed from the mixture of a one to one ratio mixture by weight of UTC (Urentane Technology Company, Inc.) A Component (Polymeric MDI) and UTC B Water Blown B components at a preferred temperature of around 70° Fahrenheit. The A component is composed of Polymethylene polyphenylene ester. The B component is a Polyether polyol blend.

The preferred embodiment uses non-metallic catalysts and initiators and are painted with non-metallic, carbon free paints resulting in a substantially RF-Transparent polyurethane foam and product. The lack of metallic catalysts and initiators allows RF waves to travel through the polyurethane foam devices without being impeded, reflected or deflected.

As disclosed in U.S. Pat. No. 5,185,383, hereby incorporated by reference, Component A and a component B are mixed in a 1:1 volume ratio, and as component A, an organic polyisocyanate materials in the formula R(NCO).sub.n, where R represents polyfunctional, optionally, urethane, biuret, carbodiimide, and isocyanurate group-containing aliphatic, cycloaliphatic, araliphatic, or preferably aromatic radicals or mixed radicals of the type. n is a whole number whose value is equal to the valence of R and is at least 2, for example from 2 to 6, and preferably from 2 to 3. Typical individual examples include aliphatic di-isocyanates such as ethylene di-isocyanate, 1,2-propylene di-isocyanate, 1,4-butylene di-isocyanate, 2,2,4-trimethylhexamethylene-1,6-di-isocyanate, 2-ethylbutylene 1,4-di-isocyanate, and preferably 1,6-hexamethylene di-isocyanate cycloaliphatic di-isocyanates such as 1,2-cyclohexane di-isocyanate, 1,4-cyclohexane di-isocyanate, 1-methylcyclohexane 2,4-di-isocyanate and 2,6-di-isocyanate as well as corresponding isomer mixtures, 4,4'-,2,4'-, and 2,2'-dicyclohexylmethane di-isocyanate as well as corresponding isomer mixtures, and preferably 3-isocyanatomethyl 3,5,5-trimethylcyclohexylisocyanate, and polyisocyanate such as polycyclohexylpolymethylene polyisocyanates having from 2 to 6, preferably 3, cyclohexylene radicals in the molecule, and preferably aromatic polyisocyanates such as meta- or para-phenylene di-isocyanates, biphenyl di-isocyanate, 2,4- and 2,6-toluene di-isocyanate and corresponding isomer mixtures, 4,4'-, 2,4'-, and 2,2'-diphenylmethane di-isocyanate and corresponding isomer mixtures, mixtures of 4,4'-, 2,4'-, and 2,2'-diphenylmethane di-isocyanates and polyphenyl polymethylene polyisocyanates polymeric MDI) and mixtures of polymeric MDI and toluene di-isocyanates.

As component B, the system includes the hydroxyl group containing component which consists essentially of a mixture of at least one member of the group of factors (i) and (ii). Factor (i) consists essentially of a condensation product of an aliphatic triol, propanol or ethanol. The aliphatic chain length is suitably from 3 to 20 carbon atoms prior to condensation, preferably from 3 to 12 carbon atoms. The condensation product, having a hydroxyl number of about 50 to 650 has a molecular weight of from about 250 to about 1600.

These condensation products are produced by conventional methods which are well known in the art.

These ethoxylated or propoxylated triols reduce the viscosity of the B component and enhance the curing of the foam material.

Factor (ii) consists essentially of a condensation product of a hexose with propanediol or propanetriol. Suitable hexoses include linear or cycloaliphatic hexoses which may be either industrially produced or naturally derived. Suitable propanediols include 1,1-propanediol, 1,2-propanediol, and 1,3-propanediol. Suitable propane triols include 1,1,1-propane triol, 1,1,2-propane triol, 1,1,3-propane triol, as well as all other propane triol permutations. These propanediols and propanetriols are made by conventional methods. The condensation of the propanediols or triols with hexose is performed by conventional reactions well known in the art. The molecular weight of the resulting condensation products ranges from 200 to 3000 and has a hydroxyl number of from about 200 to about 800 and a functionality of 4–5.

This condensation product is used as a cross-linking agent in the foam and to improve the foam's heat resistance. The condensation product helps to eliminate scorching of the foam once it is applied to a substrate; and also to eliminate possible ignition during the spraying.

Component B of the system also includes factor (iii), that is an aliphatic aminopolyol, or aliphatic polyesterpolyols, or aliphatic polyetherpolyols.

In the aliphatic aminopolyol, the aliphatic chain length may be from 3 to 20 carbon atoms long. The hydroxyl number of aliphatic aminopolyol is from about 300 to about 900 and has a functionality of from 3–5, and molecular weight range of 600 to 3000.

Suitable aliphatic amino polyols include, dialkanol amines such as, for example, diethanol amino and the like, N-alkyl dialkanol amines such as, for example, N-methyl diethanol amines, trialkanol amines, such as for example, triethanol amine and the like, N,N,N',N'-tetrakis (2-hydroxy propyl) ethylene diamine and the like.

These compounds, which are made by one of conventional methods, have the effect of lowering the viscosity of component B and improving the cure time of the foam.

In the aliphatic polyester polyols, the chain length of the aliphatic moiety may be from 3 to 20 carbon atoms long. The hydroxyl number of the aliphatic polyester polyol is from about 300 to about 900 and has a functionality of from 3–5 and molecular weight range of 220 to 600.

Suitable polyester polyols may be prepared, for example, from organic dicarboxylic acids having from 2 to 12 carbon atoms, preferably alihatic dicarboxylic acids having from 4 to 6 carbon atoms, and polyfunctional alcohols, preferably diols, having from 2 to 12 carbon atoms, preferably from 2 to 6 carbon atoms. Typical dicarboxylic acids are: succinic acid, glutaric acid, adipic acid, suberic acid, azelaic acid, sebacic acid, decane dicarboxylic acid, maleic acid, and fumaric acid. The dicarboxylic acids may be used individually and as mixtures with one another. Corresponding derivatives of the dicarboxylic acids may be used instead of the free dicarboxylic acids—for example, the dicarboxylic acid esters of alcohols having from 1 to 4 carbon atoms, or dicarboxylic anhydrides. Preferably, dicarboxylic acid mixtures of succinic, glutaric, and adipic acid are used in amounts of, for example, 20–35; 35–50; 20–32 parts by weight. Examples for di- and tri-functional alcohols, in particular diols, are ethanediol, diethylene glycol, 1,2-respectively 1,3-propanediol, dipropylene glycol, 1,4-butanediol, 1,5-pentanediol, 1,6-hexanediol, 1,10-decanediol, glycerine, and trimethylolpropane. Preferably used are ethanediol, diethylene glycol, 1,4-butanediol, 1,5-pentanediol, 1,6-hexanediol, or mixtures of at least two of the cited diols, in particular mixtures of 1,4-butanediol, 1,5-pentanediol, and 1,6-hexanediol. In addition, polyester polyols derived from lactones may be used, for example, n-caprolactone, as may hydroxy carboxylic acids, for example, -hydroxycaproic acid, the polyester polyols for example, from -hydroxycaproic acid.

These aliphatic polyester polyols, which are also produced by well known conventional methods, have the same affect in component B as the aliphatic amino polyol.

In the aliphatic polyether polyols, the aliphatic chain length may be from 3 to 20 carbon atoms long. The hydroxyl number of the aliphatic polyether polyol is from about 300 to about 900; the compounds have a functionality of 3–5 and a molecular weight range of 200 to 3000.

The aliphatic polyether polyols are produced with known methods, for example through anionic polymerization with alkali hydroxides such as sodium or potassium hydroxide, or alkali alcoholates such as sodium methylate, sodium or potassium methylate, or potassium isopropylate as catalysts on an initiator which contains bonded to the molecular from 2 to 6 reactive hydrogen atoms, preferably from 2 to 3, or through cationic polymerization with Lewis acids such as antimony pentachloride, boron fluoride etherate, etc. or bleaching earth as catalysts from one or more alkylene oxides having from 2 to 4 carbon atoms in the alkylene radical. Suitable alkylene oxides, are for example, tetrahydrofuran, 1,3-propylene oxide, 1,2- and 2,3-butylene oxide, styrene oxide, epichlorohydrin, and preferably ethylene oxide and 1,2-propylene oxide. The ethylene oxides may be used individually, alternately one after another, or as mixtures. The affect of the aliphatic polyether polyols is the same in component B as that of the aliphatic amino polyols described above.

Component B further includes an aromatic polyol which is the condensation product of phenol and one or more of the amino polyols described above. The aromatic amino polyol has a hydroxyl number of from about 200 to about 800 and a functionality of 3–5. Suitable compounds include polyalkylene oxide polyols.

The aromatic amino polyols contribute good dimensional stability to the foam, as well as high compressive strength, good foam adhesion and superior fire retardancy.

Component B further includes a polyurethane rapid initiator. Suitable initiators include triethylamine, tributylamine, dimethylbenzylamine, N-methyl-, N-ethyl-N-cyclohexyl-morpholine, N,N,N',N'-tetramethylethylenediamine, N,N,N'-N'-tetramethylbutanediamine, entamethyldiethylenetriamine, tetramethyl-diaminoethylether, bis(dimethylaminopropyl) urea, dimethylpiperazine, 1,2-dimethylimidazol, 1-azabicyclo(3.3.0)octane and preferably 1,4-diazabicyclo (2.2.2)-octane, and alkanolamine compounds such as triethanolamine, di-isopropanolamine, N-methyl- and N-ethyldiethanolamine, and dimethylethanolamine.

These materials are commercially available from Union Carbide Corporation, Air Products and Chemical, Inc. Rhein Chemie.

Further suitable initiators include triethylamine, diethyleneamine, naphthenate, tin and naphthenate. The initiator that is used must be substantially RF-transparent. The initiator helps speed up the reaction between components A and B and reduces cure time of the foam. The metal initiators should be avoided in the preferred embodiment if they reduce the RF transparency of the polyurethane foam.

A further ingredient in component B is base surfactant. Useful surfactants include for example, those well known in the art, e.g., organo-silicone ethers. One preferred polyether silicone is designated Surfactant L-532, commercially available from Union Carbide Corporation. Another is dimethylpolysiloxane, commercially available from Air Products and Chemical and Goldschmidt Co.

Where present in component B and the resultant foam, the surfactant helps control the foams' cell structure and size.

Factor (vii) in component B is a catalyst from the hydroxyl/di-isocyanate polymerization reaction. Suitable catalysts for this reaction include triethanolamine, dimethylethanolamine, and the tertiary amine tri(3-dimethylamine)propylamine. The metal catalysts should be avoided in the preferred embodiment if they reduce the RF transperancy of the polyurethane foam.

Factor (viii) of component B is water. Any conveniently available source of water, e.g., tap water, is suitable for inclusion in component B. As is well known, the water reacts with the isocyanate groups of component A, resulting in the release of carbon dioxide and hence, foaming of the liquid mixture. Thus the co-mingled components are converted to a durable state while being imparted with the characteristic foam structure.

In this preferred embodiment, component A comprises diphenylmethano di-isocyanate. Component B consists essentially of factors (i) through (viii) as described above with the following modifications. Component B consists essentially of a mixture totaling 100 parts by weight of from about 18 to 45 parts of at least one member of the group of factors (i) and (ii). Factor (i) consists essentially of from 25 to about 12 parts of the condensation product of an aliphatic triol with a propanol or ethanol as described above. Factor (ii) consists essentially of from 6 to about 18 parts of a condensation product of a hexose with a propane diol or propane triol as described above.

Component B further includes factors.(iii) through (viii) in the amounts indicated in Table I.

TABLE I

| Factor No. | Parts/100 parts of Component B |
|---|---|
| (iii) | From about 24 to about 40 |
| (iv) | From about 7.5 to about 22.5 |
| (v) | From about 0.5 to about 1.5 |
| (vi) | From about 0.5 to about 1.5 |
| (vii) | From about 0.75 to about 3.75 |
| (viii) | From about 6 to about 0.6 |

In several further embodiments of the invention, the hydroxyl group containing component contains only factor (i); or only factor (ii); or both factors of the group consisting of factors (i) and (ii).

Another embodiment of the invention has a component B which further contains as factor (ix); from about 7.5 to about 22.5 parts of a tri(haloalkylphosphate). Suitable compounds include tri(1-chloromethyl ethyl phosphate), tri(2-chloroisopropyl phosphate) and tri(3-chloro-N-pentyl phosphate). The alkyl group in these compounds has a chain length of from 2 to 12 carbon atoms. These compounds are commercially available from Akzo Albright and Wilson.

In yet a further embodiment of the invention, factor (vii) consists essentially of from about 0.25 to about 0.75 parts of a catalyst for the water/di-isocyanate polymerization reaction and from about 1 to about 3 parts of a catalyst for the polyol/di-isocyanate polymerization reaction. This embodiment may optionally further contain from about 7.5 to about 22.5 parts of a tri(haloalkyl phosphate).

In a preferred embodiment of the invention, component B consists essentially of a mixture totaling 100 parts by weight of from about 18 to about 45 parts of at least one member of the group of factors (i) and (ii), the factors consisting essentially of (i) from about 25 to about 12 parts of a condensation product of an alihatic triol with propanol or ethanol of hydroxyl number from about 50 to about 650 and a molecular weight of about 250 to about 1600, where at least one member of the group consists of propoxylated glycerol and ethoxylated glycerol, (ii) from about 6 to about 18 parts of a condensation product of a hexose with propane diol or propane triol of hydroxyl number from about 200 to about 800 and a functionality of 4–5, where at least one member of the group consists of propoxylated sucrose and propoxylated glycerol; factors (iii) and (iv) being as above described; and in factor (v) at least one member of the group consists of triethylamine, diethylamine, lead naphthenate, tin naphthenate and tin mercaptan, although the metals should be avoided if they reduce the RF transperancy; the surfactant is a polysiloxate; factor (ix) is a tri(lower alkyl phosphate) of 1–4 carbons in the alkyl moiety, and factor (x) is at least one member of the group consisting of pentamethyl-diethylenetriamine and triethylamine, and factor (xii) is at least one member of the group consisting of tris(3-dimethylamino)propylamine and diethylene amine.

Due to the unique blend of factors in component B, when components B and A are mixed, a simultaneous reaction of water and polyether alcohols with the NCO groups will occur. Due to the unique catalyzation, a second stage reaction between the hydroxyl and NCO groups has been eluted. Therefore the resultant foam will rise uniformly without any shear characteristics. The foam is based on the present invention to include components A and B in substantially equal volume amounts.

Another embodiment of the invention is a polyurethane foam created with the use of fluorinated hydrocarbons created from a system comprising components A and B, where component A is diphenylmethane di-isocyanate and component B is the hydroxyl group containing component. A preferred variant of this embodiment is a foam having a compressive strip of from about 1.5 to about 4.5 kg/cm.sup.2 and a density of from about 15 to about 80 kg/m.sup.3.

Compressive strength is measured in accordance with ASTM D-1621. Specimens with the dimensions of 2".times.2".times.1" were used for the test. The compressive strength was calculated from the maximum load (a yield point or a 10% deformation was reached), dividing the area of cross sections. This description of compressive strength is drawn from U.S. Pat. No. 4,454,251, column 6, lines 49–57 which is incorporated here by reference. The resulting foam has fine uniform cell structure with good strength and dimensional stability.

In a preferred embodiment, each of the respective components A and B are selected to provide substantially molar equivalent numbers of isocyanate groups in component A and hydroxyl in component B.

The following examples describe in detail most components A and B for making the polyurethane foams to be used in antenna concealment. Many modifications, both of materials and methods can be made without departing from the spirit and scope of this invention.

EXAMPLE I

A polyurethane foam to be use in the concealment of antenna made in accordance with Table II.

TABLE II

Conventional Polyurethane Foam Composition

| Ingredient | % by Weight |
|---|---|
| Component A | |
| diphenylmethane di-isocyanate | 90% |
| tri(1-chloromethyl ethyl phosphate)/tri(2-chloroisopropyl phosphate) | 10% |
| Component B | |
| polyalkylene oxide polyol | 27.7–37.2% |
| polyester and polyethyl polyols | 28.0–30.34% |
| diethyleneglycol (2.2-oxy-bis-ethanol) | 7.0–6.17% |
| tri(1-chloromethyl and tri(2-chloro-iso-propyl) | 8.0–8.98% |
| polysiloxane | 0.4–0.4% |
| N,N-dimethylethanol amine | 0.8–0.8% |
| 24% lead naphthenate solution | 0.1–0.11% |
| trichlorofluoromethane | 28.0–16.0% |

Component B is made by adding each of the listed elements in Table II to a vessel in the sequence in which they are listed. After addition, each new element is added to the mixture already there. Component B is held separate from component A until such time as they are sprayed from conventional spraying equipment. The density of the resultant foam is 1.5–3.0 pcf.

EXAMPLE II

A polyurethane foam to be use in the concealment of antenna made in accordance with Table III.

TABLE III

| Ingredient | % by weight |
|---|---|
| Component A | |
| diphenylmethane di-isocyanate (2.2–2.4) | 125.0% |
| Component B | |
| oxypropylated and ethylated glycerol | 30.0–11.8% |
| aliphatic amino polyol | 24.0–40% |
| propoxylated sucrose/propoxylated glycerol | 12.5–12.5% |
| polyalkylene oxide polyol | 15.0–15.0% |
| tri(1-chloromethyl and tri(2-chloro-iso-propyl) | 15.0–15.0% |
| H.sub.2 O | 4.0–1.2% |
| Polysiloxane | 1.0–1.0% |
| triamine/diethylene amine | 1.0–1.0% |
| Pentamethyl diethylene triamine | 0.5–0.5% |
| Tris(3-dimethylamine) propylamine | 2.0–2.0 |

The mixing of components A to B in both the conventional and the novel foam is 100 parts of component A to 100 parts of component B, or 1:1 by volume. The density of the resultant foam is 1.5–3.0 pcf.

EXAMPLE III

A polyurethane foam to be used in the concealment of antenna made in accordance with Table IV.

TABLE IV

| Ingredient | % by weight |
|---|---|
| Component A | |
| diphenylmethane di-isocyanate (2.2–2.4) | 125.0% |
| Component B | |
| oxypropylated and ethylated glycerol | 29.5% |
| aliphatic amino polyol | 20.0% |
| propoxylated sucrose/propoxylated glycerol | 12.5% |
| polyalkylene oxide polyol | 15.0% |
| tri(1-chloromethyl) ethylphosphate and tri(2-chloro)isopropyl phosphate | 15.0% |
| H.sub.2 O | 3.5% |
| Polysiloxane | 1.0% |
| triamine/diethylene amine | 1.0% |
| Pentamethyl diethylene triamine | 0.5% |
| Tris(3-dimethylamine) propylamine | 2.0% |

The mixing components A to B in both conventional and the novel foam is 100 parts of component A to 100 parts of component B, or 1:1 by volume. The density of the resultant foam is 2.0 pcf (32 kg/m. sup.3).

EXAMPLE IV

A polyurethane foam to be used in the concealment of antenna made in accordance with Table V.

TABLE V

| Ingredient | % by weight |
|---|---|
| Component A | |
| diphenylmethane di-isocyanate (2.2–2.4) | 125.0% |
| Component B | |

TABLE V-continued

| Ingredient | % by weight |
|---|---|
| oxypropylated and ethylated glycero | 23.8% |
| aliphatic amino polyol | 26.0% |
| propoxylated sucrose/propoxylated glycerol | 13.4% |
| polyalkylene oxide polyol | 15.0% |
| tri(1-chloromethyl) ethylphosphate and tri(2-chloro) isopropyl phosphate | 15.0% |
| H.sub.2 O | 2.9% |
| Polysiloxane | 1.0% |
| triamine/diethylene amine | 1.0% |
| Pentamethyl diethylene triamine | 0.5% |
| Tris(3-dimethylamine) propylamine | 2.0% |

The mixing of components A to B in both conventional and the novel foam is 100 parts of component A to 100 parts of component B, or 1:1 by volume. The density of the resultant foam is 2.4 pcf(38.5 kg/m.sup.3).

EXAMPLE V

A polyurethane foam to be use in the concealment of antenna made in accordance with Table VI.

TABLE VI

| Ingredient | % by weight |
|---|---|
| Component A | |
| diphenylmethane di-isocyanate (2.2–2.4) | 125.0% |
| Component B | |
| oxypropylated and ethylated glycerol | 20.0–11.8% |
| aliphatic amino polyol | 29.8–40% |
| propoxylated sucrose/propoxylated glycerol | 13.4–12.5% |
| polyalkylene oxide polyol | 15.0–15.0% |
| tri(1-chloromethyl) ethyl phosphate and tri(2-chloro) isopropyl phosphate | 15.0–15.0% |
| H.sub.2 O | 2.3–1.2% |
| Polysiloxane | 1.0–1.0% |
| triamine/diethylene amine | 1.0–1.0% |
| Pentamethyl diethylene triamine | 0.5–0.5% |
| Tris(3-dimethylamine) propylamine | 2.0–2.0 |

The mixing of components A to B in both the conventional and the novel foam is 100 parts of component A to 100 parts of component B, or 1:1 by volume. The density of the resultant foam is 3.0 pcf (48 kg/m.sup.3).

Figure 7:
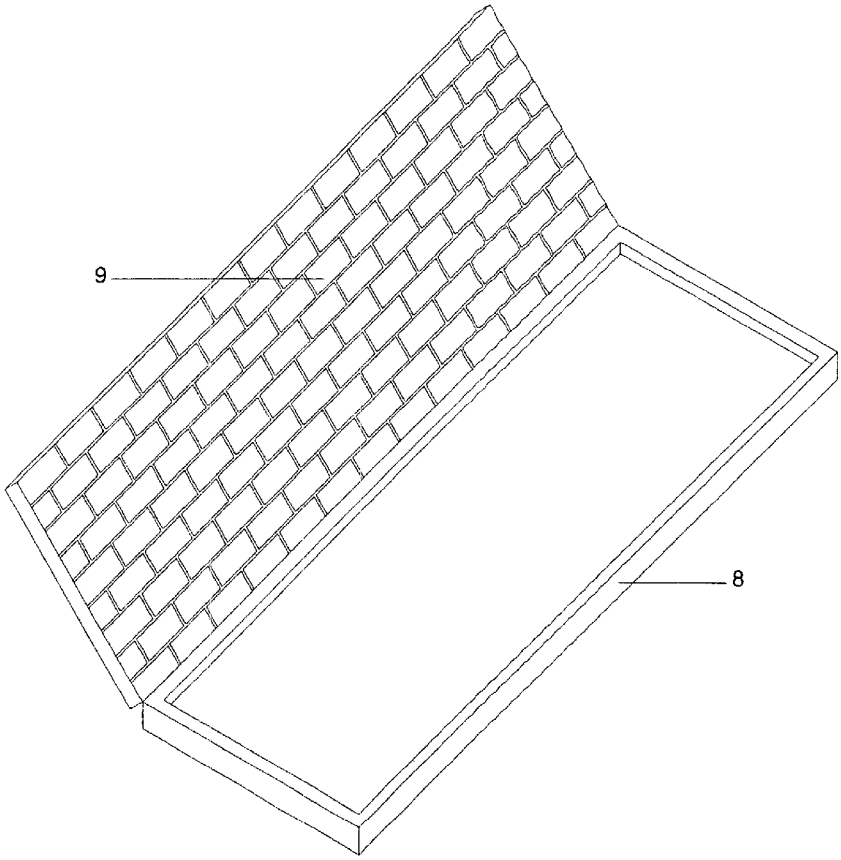
FIG. 7 shows a view of a mold used to create the concealment panels. The mold has an inverse brick pattern.

In the preferred embodiment using one of the formulas above in which the examples that do not use metallic catalysts or initiators are preferred, the A and B components are thoroughly mixed for one minute at 2,500 RPM and then poured into a wooden mold 8. The mold 8 as shown in FIG. 7 should have an inverse pattern 9 on at least one side formed by an one and one-half inch layer of M-2 RTV Silicone rubber base, the preferred is Waker Elastosil® M4670 A and B.

Paint is applied to the mold surface. The paint adds the proper color to the polyurethane foam adding to its concealment properties while also acting as a mold release agent. The preferred paint is a Sherwin-Williams F78 type metal paint. It has a low sheen and is available in numerous colors. The color of the paint or paints depends on the desired concealment.

After the mixture is poured into the mold 8, the top of the mold 8 is closed and the mold 8 is sealed by clamps until the mixture is cured. The mold 8 should have a means for excess air to escape. The preferred means to allow air to escape is the drilling of ⅛" drill-holes in the top of the mold. This allows the air to escape while minimizing the amount of trapped carbon dioxide in the foam device. The preferred mold size is 2 inches thick by 4 feet wide and 8 feet in height. The foam device may have the top side planed with a lathe to produce a more even surface. This will also remove some of the top layer of the device that has the most concentration of carbon dioxide produced bubbles or holes in the foam.

The physical properties of molding foam system (Table VII) and concealment devices (Table VIII) are given below:

TABLE VII

URTHANE TECHNOLOGY COMPANY, INC.
PHYSICAL PROPERTIES OF TYPICAL MOLDING FOAM SYSTEMS
Confidence Level - 90%

| | Density LB/CU. FT | | | | | | |
|---|---|---|---|---|---|---|---|
| | 2 | 4 | 6 | 8 | 10 | 15 | 20 |
| Compressive Strength - P.S.I. | 40 | 90 | 180 | 250 | 360 | 580 | 800 |
| Tensile Strength - P.S.I | 30 | 110 | 1,175 | 225 | 360 | 450 | 700 |
| Elastic Modulus - P.S.I | 1,500 | 3,000 | 4,250 | 5,800 | 8,000 | 12,500 | 18,000 |
| Shear Strength - P.S.I | 30 | 70 | 100 | 130 | 180 | 230 | 390 |
| Shear Modulus - P.S.I | 380 | 750 | 1,250 | 1,800 | 2,000 | 3,000 | 4,500 |
| Flexural Strength - P.S.I | 50 | 120 | 240 | 350 | 450 | 750 | 1,200 |
| Flexural Modulus - P.S.I | 600 | 2,250 | 4,500 | 7,000 | 10,000 | 20,000 | 80,000 |

TABLE VII

PHYSICAL PROPERTIES OF FOAM CONCEALMENT DEVICES
Confidence Level - 90%

| Density LB/CU. FT | 2 | 10 | 15 |
|---|---|---|---|
| Compressive Strength - PSI. | 40 | 360 | 580 |
| Tensile Strenath - P.S.I. | 30 | 360 | 450 |
| Elastic Modulus - P.S.I. | 1,500 | 8,000 | 12,500 |
| Shear Strength - P.S.I. | 30 | 180 | 230 |
| Shear Modulus - P.S.I. | 380 | 2,000 | 3,000 |
| Flexural Strength - P.S.I. | 50 | 450 | 750 |
| Flexural Modulus - P.S.I. | 600 | 10,000 | 20,000 |

In the preferred embodiment, the mold for the polyurethane concealment material is constructed as follows: First, a template is created to match the desired structure. Typically, a rubber mold border is built up to approximately 2" in height. In the preferred embodiment, the facade is fabricated out of various materials such as plastic, mortar compound, parex, and different types of glues. All surface areas of the facade are then sealed with silicon that is widely available in the market. A ½" wide boarder is built all around the template. This gives the sides to the mold.

Once the template is complete, the appropriate amount of silicon and hardener is weighted-out. The silicon and hardener are then combined and mixed with a drill at 750 RPMs for approximately 15 minutes. The mixed silicon mixture is then poured over the template surface and into said boarder. Once material has covered the template area, it is then leveled and vibrated to release any air trapped in silicon rubber.

The mold is left undisturbed for approximately 48 hours for mixed silicon rubber material to harden properly. Then mold is removed from template and flipped over to allow the inside area that was in contact to the template to air dry for approximately 8 hours.

In the preferred embodiment, the general specifications are that the mold will be ½" to ¾" in thickness throughout the structure.

The A and B components are thoroughly mixed for one minute at 2,500 RPM and then poured into a wooden mold 8. The mold 8 as shown in FIG. 7 should have an inverse pattern 9 on at least one side formed by a one and one-half inch layer of M-2 RTV Silicone rubber base. After the mixture is poured into the mold 8, the top of the mold 8 is closed, and the mold 8 is sealed by clamps until the mixture is cured. The mold 8 should have a means for excess air to escape. The preferred panel size is 2 inches thick by 3 feet wide and 8 feet in height.

The mold 8 size versus the amount of the A and B mixture can be changed to produce a different required density and strength of material.

Figure 8A:
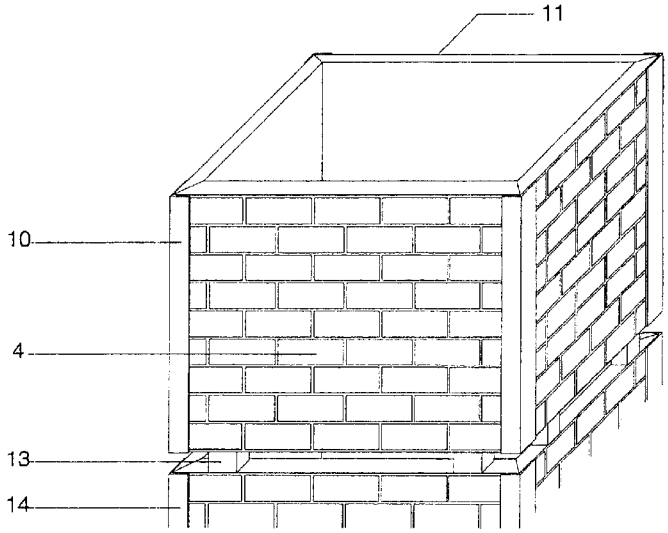
FIG. 8*a* shows a side view of how multiple panels may be used to form an antenna enclosure. Antenna enclosures can be made in a number of ways. They can consist of a single panel covering the antenna or multiple panels surrounding the antenna.
Figure 8B:
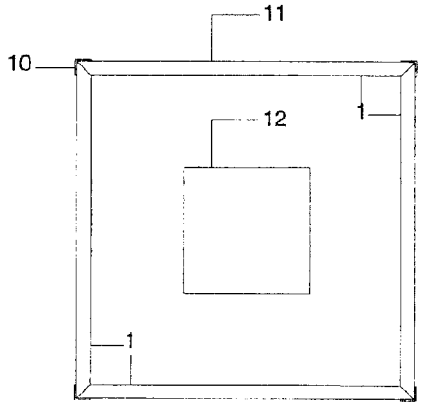
FIG. 8*b* shows a top view of how multiple panels may be used to form an antenna enclosure. Antenna enclosure can be made in a number of ways. They can consist of a single panel covering the antenna or multiple panels surrounding the antenna.

The panels can be used to form an antenna enclosure 10 as shown in FIG. 8. Four foam camouflage panels 1 are connected together through the use of connecting means 13. The pattern 4 on the camouflage panels 1 matches the architecture of the building 14 that the antenna enclosure is on. The antenna enclosure conceals the antenna 12.

Figure 9:
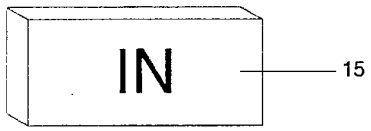
FIG. 9 shows the concealment panel formed in the shape of an exit sign.

The camouflage panels 1 may be in the shape of an exit sign 12 as in FIG. 9 which allows for extra concealment.

Figure 10A:
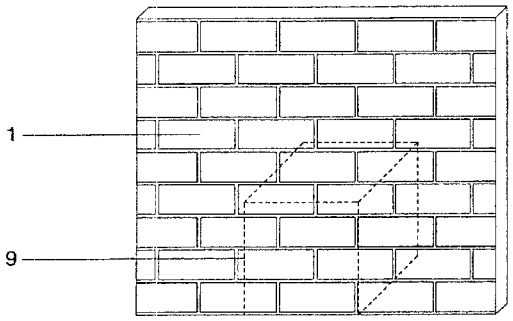
FIG. 10*a* shows a side view of how a single panel may be used to camouflage an antenna.
Figure 10B:
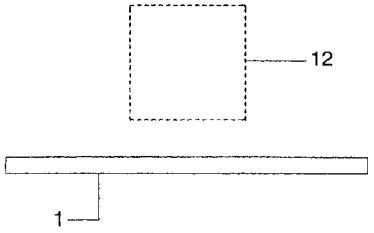
FIG. 10*b* shows a top view of how a single panel may be used to camouflage an antenna.

A single or multiplicity of camouflage panels 1 can be used to conceal the antenna 9. FIG. 10 shows how a single camouflage panel 1 may be used to conceal the antenna 12.

Figure 11A:
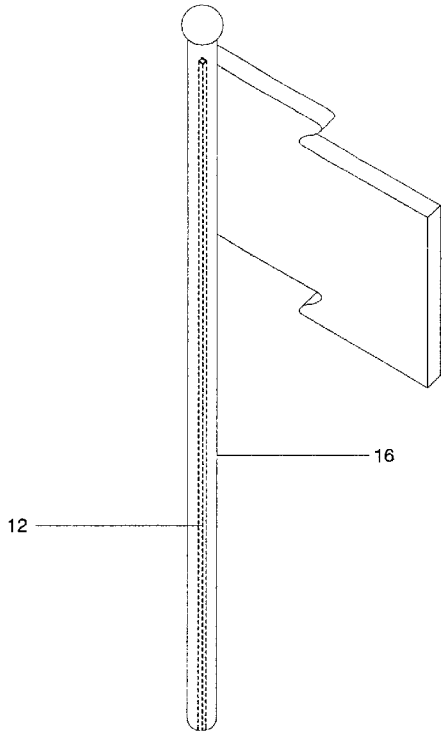
FIGS. 11*a* and 11*b* show the concealment panel formed in the shape of a flag pole.
Figure 11B:
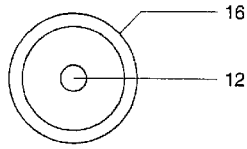
Figure 12A:
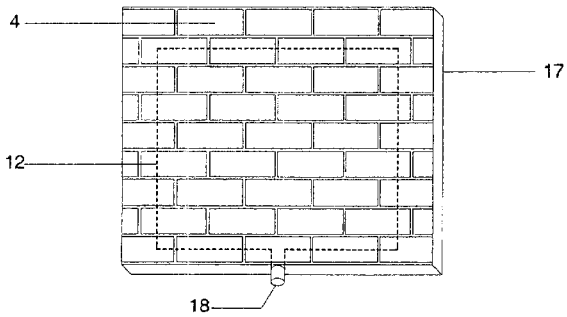
Figure 12B:
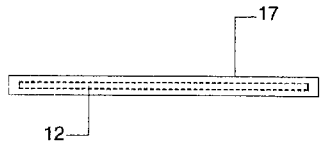
Figure 12C:
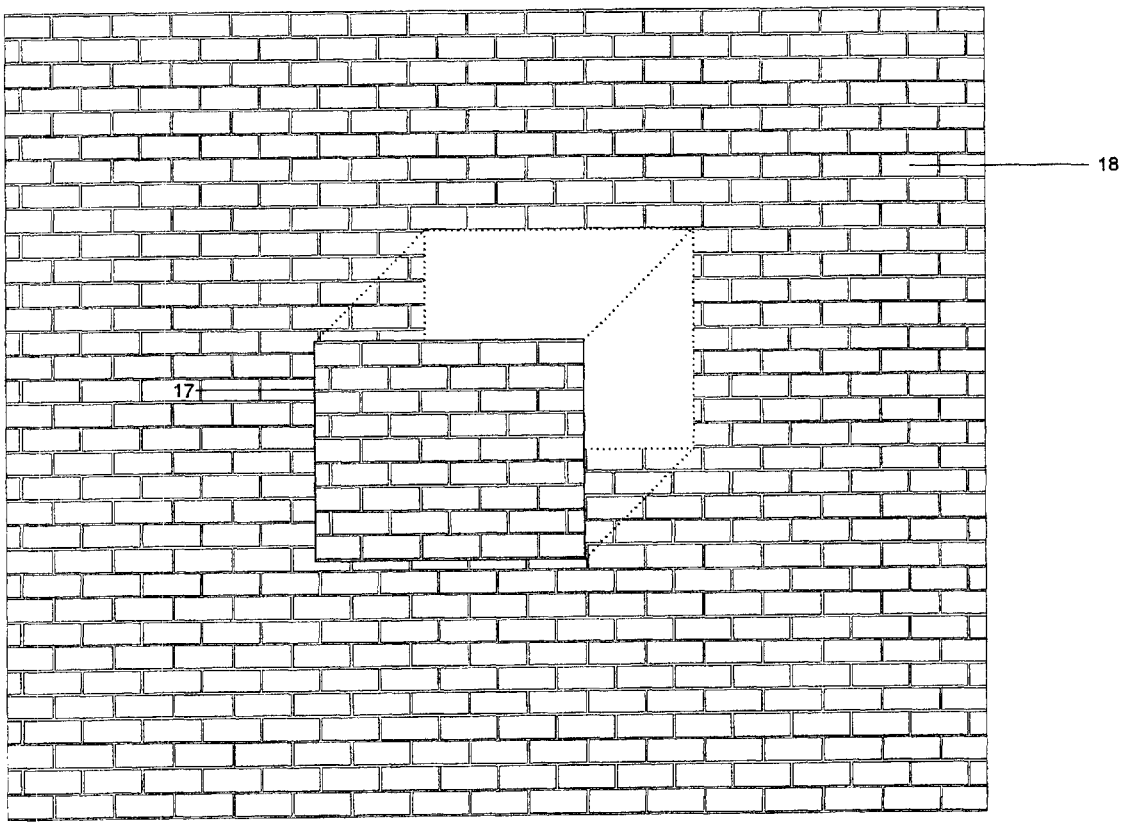
Figure 13:
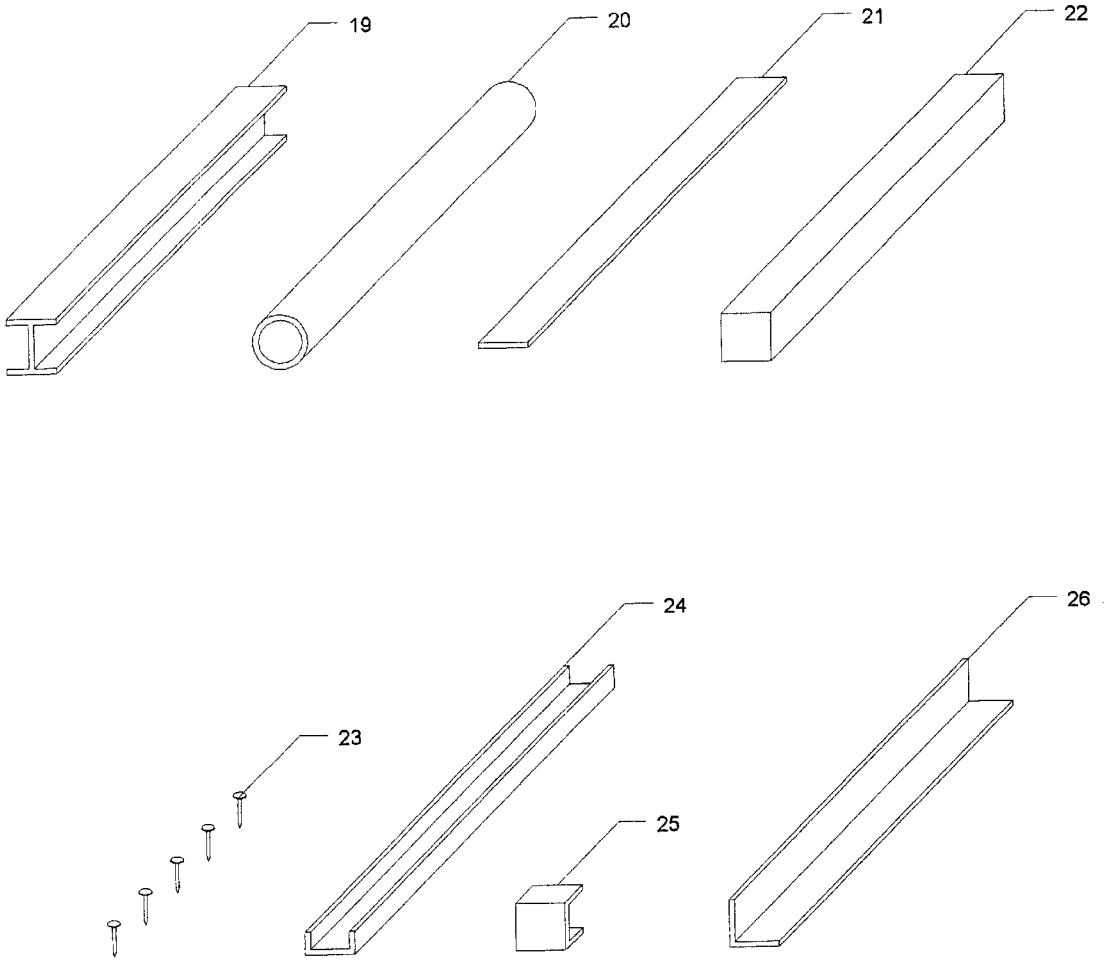
Figure 14A:
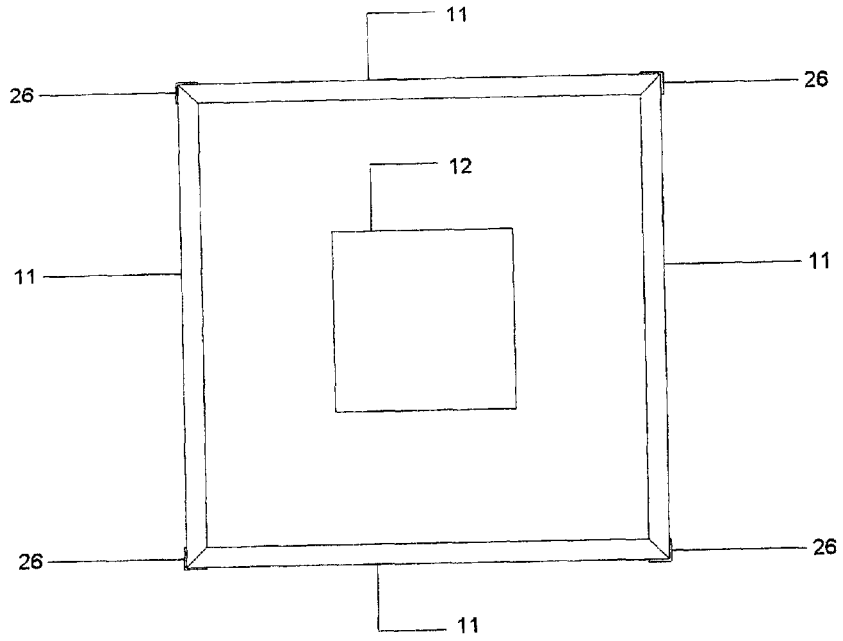
Figure 14B:
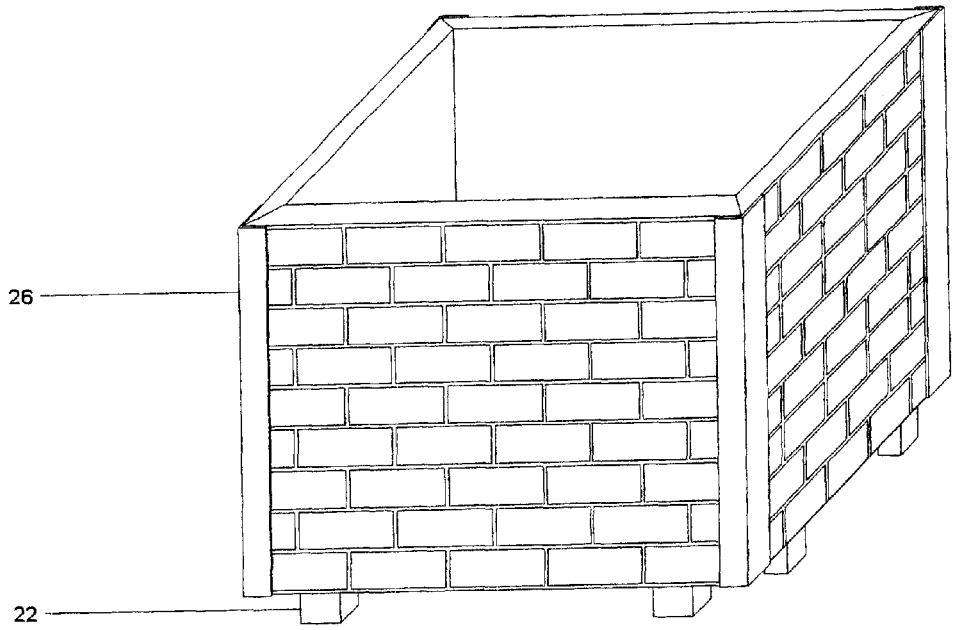

The camouflage panels 1 may be in the shape of a pole such as a flag pole 16 as in FIG. 11 which allows for extra concealment.

Alternative Embodiment

A higher density foam can be created by using a 40 pd density foam. The construction material in formed out of molds. These molds are created as described above, except the rubble mold is formed by enclosing the desired construction material. A 20 pd foam formula is used, which is compressed by a factor of two to produce the 40 pd density foam material. The packing factor is 50%, whereby twice the amount of the A and B compounds are placed in the same space(mold). This forms a higher density polyurethane foam material which as the consistency of wood and/or other building materials. The formula to control the density is as follows: (L×W×H)/1728×D/2=Lbs per part where L is length, W is wide, H is height and D is Density.

Advantages

The previously described embodiments of the present invention have many advantages including cost effective, more structurally sound, easy to use and substantially RF-transparent while providing extremely effective concealment. The polyurethane foam also proves to be fire resistant with a fire hazard classification of ASTM E-84. The present invention adds to the efficiency and productiveness of the antenna concealment industry.

Conclusion, Ramifications, and Scope

Although the present invention has been described in considerable detail with reference to certain preferred versions thereof, other versions are possible. For example, the patterns formed in the Polyurethane Devices could be different patterns to match different architectural surroundings or an equivalent to the Polyurethane Foam Finish could be used in the processing or a different mixture of the components could be used or a different process could be used to make the polyurethane foam concealment devices or a different shape could be used. Therefore, the point and scope of the appended claims should not be limited to the description of the preferred versions contained herein.

That which is claimed:

1. A camouflage panel consisting of:

a polyurethane foam formed of a mixture of diphenylmethane di-isocyanate, and a hydroxyl group containing a mixture totaling 100 parts by weight of from about 18 to about 45 parts of at least one member selected from the group consisting of factors (i) and (ii), i) from about 25 to about 12 parts of a condensation product of an aliphatic triol with propanol or ethanol of hydroxyl number from about 50 to about 650 and molecular weight from about 250 to about 1600, and ii) from about 6 to about 18 parts of a condensation product of a hexose with propane diol or propane triol of hydroxyl number from about 200 to about 800 and functionality of 4–5, and from about 24 to about 40 parts of an aliphatic aminopolyol of hydroxyl number from about 300 to about 900 and a functionality of 3–5, from about 7.5 to about 22.5 parts of an aromatic aminopolyol of hydroxyl number from about 200 to about 800 and a functionality of 3–5, from about 0.5 to about 1.5 parts of a polyurethane rapid initiator, from about 0.5 to about 1.5 parts of a surfactant from about 0.75 to about 3.75 parts of a catalyst for the hydroxyl/di-isocyanate polymerization reaction, and from about 6 to about 0.6 parts of water which is substantially RF-transparent from 0 MHz to 100,000 MHz; and used to conceal an RF transmitting and/or receiving means.

2. The camouflage panel according to claim 1:

in which one or more sides has a stucco pattern.

3. The camouflage panel according to claim 1:

in which one or more sides has a brick pattern formed by brick or tile.

4. The camouflage panel according to claim 1:

in which one or more sides has a stone pattern.

5. The camouflage panel according to claim 1:

in which one or more sides has a plastic pattern.

6. The camouflage panel according to claim 1:

in which one or more sides has a wood pattern.

7. The camouflage panel according to claim 1:

in which the panel forms the shape and look of an exit sign.

8. The camouflage panel according to claim 1:

in which the panel forms the shape and look of a pole.

9. A camouflage panel consisting of:

a polyurethane foam formed of a mixture of diphenylmethane di-isocyanate, and a hydroxyl group containing a mixture totaling 100 parts by weight of from about 18 to about 45 parts of at least one member selected from the group consisting of factors (i) and (ii), (i) from about 25 to about 12 parts of a condensation product of an aliphatic triol with propanol or ethanol of hydroxyl number from about 50 to about 650 and molecular weight from about 250 to about 1600, and ii) from about 6 to about 18 parts of a condensation product of a hexose with propane diol or propane triol of hydroxyl number from about 200 to about 800 and a functionality of 4–5, and from about 24 to about 40 parts of an aliphatic aminopolyol of hydroxyl number from about 300 to about 900 and a functionality of 3–5, from about 7.5 to about 22.5 parts of an aromatic aminopolyol of hydroxyl number from about 200 to about 800 and a functionality of 3–5, from about 0.5 to about 1.5 parts of a polyurethane rapid initiator, from about 0.5 to about 1.5 parts of a surfactant, from about 0.25 to about 0.75 parts of a catalyst for the water/di-isocyanate polymerization reaction, and from about 1 to about 3 parts of a catalyst for the polyol/di-isocyanate polymerization reaction, from about 6 to about 0.6 parts of water and from about 7.5 to about 22.5 parts of a tri (haloalkyl phosphate); which is substantially RF-transparent from 0 MHz to 100,000 MHz; and used to conceal an RF transmitting and/or receiving means.

10. The camouflage panel according to claim 9:

in which one or more sides has a stucco pattern.

11. The camouflage panel according to claim 9:

in which one or more sides has a brick pattern formed by brick or tile.

12. The camouflage panel according to claim 9:

in which one or more sides has a stone pattern.

13. The camouflage panel according to claim 9:

in which one or more sides has a plastic pattern.

14. The camouflage panel according to claim 9:

in which one or more sides has a wood pattern.

15. The camouflage panel according to claim 9:

in which the panel forms the shape and look of an exit sign.

16. The camouflage panel according to claim 9:

in which the panel forms the shape and look of a pole.

* * * * *